US009854957B2

(12) United States Patent
Kumar et al.

(10) Patent No.: US 9,854,957 B2
(45) **Date of Patent: *Jan. 2, 2018**

(54) METHODS FOR OPERATING DISHWASHER APPLIANCES HAVING ENERGY RECOVERY FEATURES

(71) Applicant: General Electric Company, Schenectady, NY (US)

(72) Inventors: Shree Kumar, Bangalore (IN); Ronald Scott Tarr, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/001,381

(22) Filed: Jan. 20, 2016

(65) Prior Publication Data

US 2017/0202423 A1 Jul. 20, 2017

(51) Int. Cl.
*A47L 15/00* (2006.01)
*A47L 15/23* (2006.01)
(Continued)

(52) U.S. Cl.
CPC ..... *A47L 15/0042* (2013.01); *A47L 15/0002* (2013.01); *A47L 15/0047* (2013.01); *A47L 15/23* (2013.01); *A47L 15/4225* (2013.01); *A47L 15/4259* (2013.01); *A47L 15/4261* (2013.01); *A47L 15/4285* (2013.01); *A47L 15/4293* (2013.01); *A47L 15/481* (2013.01);
(Continued)

(58) Field of Classification Search
CPC ..... A47L 15/0042; A47L 15/481; A47L 15/4285; A47L 15/0047; A47L 15/0002; A47L 15/4261; A47L 15/4259; A47L 15/507; A47L 15/502; A47L 15/23; A47L 15/4225; A47L 15/4293; A47L 2501/36
See application file for complete search history.

(56) References Cited

U.S. PATENT DOCUMENTS 4,703,629 A 11/1987 Moore
5,355,900 A 10/1994 Sakata
(Continued)

FOREIGN PATENT DOCUMENTS

DE 3626887 A1 2/1988
EP 0358279 B1 3/1990
(Continued)

*Primary Examiner* — Michael Barr
*Assistant Examiner* — Benjamin L Osterhout
(74) *Attorney, Agent, or Firm* — Dority & Manning, P.A.

(57) ABSTRACT

Dishwasher appliances and method for operating dishwasher appliances are provided. A method includes executing a wet cycle, wherein a heating unit and a fan of a desiccant assembly are active during the wet cycle. The desiccant assembly includes the heating unit, the fan, and a desiccant module and is in fluid communication with a wash chamber of the dishwasher appliance. The method further includes executing a delay period, the delay period occurring for a predetermined time period between the wet cycle and a dry cycle, wherein the heating unit and the fan are active during the delay period. The method further includes draining liquid from the wash chamber after the delay period, and executing a dry cycle, wherein the fan is active and the heating unit is inactive during the dry cycle.

7 Claims, 9 Drawing Sheets

(51) Int. Cl.
*A47L 15/50* (2006.01)
*A47L 15/48* (2006.01)
*A47L 15/42* (2006.01)

(52) U.S. Cl.
CPC ..... *A47L 15/502* (2013.01); *A47L 15/507* (2013.01); *A47L 2501/36* (2013.01)

(56) References Cited

U.S. PATENT DOCUMENTS 6,434,857 B1 8/2002 Anderson et al.
7,909,939 B2 3/2011 Brewer et al.
8,398,784 B2 3/2013 Jerg et al.
8,961,706 B2 * 2/2015 Jerg ..... A47L 15/481 134/57 D
2006/0278257 A1 * 12/2006 Jerg ..... A47L 15/481 134/56 D
2007/0234588 A1 * 10/2007 Classen ..... A47L 15/481 34/331
2007/0295373 A1 * 12/2007 Jerg ..... A47L 15/481 134/105
2010/0101613 A1 * 4/2010 Jerg ..... A47L 15/481 134/56 D
2011/0114134 A1 * 5/2011 Jerg ..... A47L 15/481 134/25.2
2011/0114136 A1 * 5/2011 Jerg ..... A47L 15/4251 134/115 R
2011/0114137 A1 * 5/2011 Jerg ..... A47L 15/4287 134/115 R
2011/0114141 A1 * 5/2011 Classen ..... A47L 15/0026 134/56 D
2011/0120510 A1 * 5/2011 Delle ..... A47L 15/4291 134/115 R
2011/0120512 A1 * 5/2011 Delle ..... A47L 15/4291 134/115 R
2011/0120513 A1 * 5/2011 Jerg ..... A47L 15/4291 134/115 R
2011/0132412 A1 * 6/2011 Jerg ..... A47L 15/481 134/115 R
2011/0139193 A1 * 6/2011 Jerg ..... A47L 15/4291 134/115 R
2011/0139194 A1 * 6/2011 Delle ..... A47L 15/4285 134/115 R
2011/0139195 A1 * 6/2011 Jerg ..... A47L 15/481 134/115 R
2011/0139196 A1 * 6/2011 Bartos ..... A47L 15/481 134/115 R
2011/0139197 A1 * 6/2011 Jerg ..... A47L 15/481 134/115 R
2011/0139198 A1 * 6/2011 Jerg ..... A47L 15/481 134/115 R
2011/0146718 A1 * 6/2011 Heidel ..... A47L 15/0034 134/18
2011/0213505 A1 * 9/2011 Ferber ..... A47L 15/481 700/286

FOREIGN PATENT DOCUMENTS

EP 2301409 A1 3/2011
EP 2556785 A1 2/2013
EP 2286708 B1 8/2013
KR 201300878489 A 8/2013
WO WO2012/062663 A1 5/2012

* cited by examiner

METHODS FOR OPERATING DISHWASHER APPLIANCES HAVING ENERGY RECOVERY FEATURES

FIELD OF THE INVENTION

The present disclosure relates generally to methods for operating dishwasher appliances, and more particularly to methods for operating dishwasher appliances which utilize desiccants to recover energy during operation.

BACKGROUND OF THE INVENTION

Modern dishwashers typically include a wash chamber where e.g., detergent, water, and heat can be applied to clean food or other materials from dishes and other articles being washed. Various cycles may be included as part of the overall cleaning process. For example, a typical, user-selected cleaning option may include a wash cycle and rinse cycle (referred to collectively as a wet cycle), as well as a drying cycle. A pre-wash cycle may also be included as part of the wet cycle, and may be automatic or an option for particularly soiled dishes.

Presently, many known dishwasher appliances utilize venting arrangements to vent moist air during the drying cycle, in order to facilitate drying. New air is drawn into the dishwasher appliance as the moist air is vented from the dishwasher appliance to the exterior environment. Such approach, however, can be problematic. For example, venting the moist air during the drying cycle can add moisture and heat to the surrounding environment, such as the kitchen or other room where the dishwasher appliance is located. Additionally, the air drawn into the dishwasher appliance from the surrounding environment can, in some cases, potentially be dirty or include undesirable particles, etc.

More recently, attempts have been made to recirculate air within the dishwasher appliances in order to reduce or avoid the above discussed disadvantages, and to generally recover the associated energy. For example, adsorbent assemblies have been utilized in dishwasher appliances in attempts to remove moisture during operation. However, known adsorbent assemblies and the methods in which they are utilized have generally proved to be relatively inefficient.

Accordingly, improved methods for operating dishwasher appliances are desired in the art. In particular, methods which provide improved air recirculation and energy recovery during operation would be advantageous.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a method for operating a dishwasher appliance is provided. The method includes executing a wet cycle, wherein a heating unit and a fan of a desiccant assembly are active during the wet cycle. The desiccant assembly includes the heating unit, the fan, and a desiccant module and is in fluid communication with a wash chamber of the dishwasher appliance. The method further includes executing a delay period, the delay period occurring for a predetermined time period between the wet cycle and a dry cycle, wherein the heating unit and the fan are active during the delay period. The method further includes draining liquid from the wash chamber after the delay period, and executing a dry cycle, wherein the fan is active and the heating unit is inactive during the dry cycle.

In accordance with another embodiment of the present disclosure, a method for operating a dishwasher appliance is provided. The method includes executing a wet cycle, wherein a heating unit and a fan of a desiccant assembly are active during the wet cycle. The desiccant assembly includes the heating unit, the fan, and a desiccant module and is in fluid communication with a wash chamber of the dishwasher appliance. The method further includes executing a delay period, the delay period occurring for a predetermined time period between the wet cycle and a dry cycle, wherein the heating unit and the fan are inactive during the delay period. The method further includes draining liquid from the wash chamber after the delay period, and executing a dry cycle, wherein the fan is active and the heating unit is inactive during the dry cycle.

In accordance with another embodiment of the present disclosure, a dishwasher appliance is provided. The dishwasher appliance includes a cabinet defining an interior, a tub disposed within the interior and defining a wash chamber for the receipt of articles for cleaning, a sump for collecting liquid from the chamber, a drain conduit for draining liquid from the tub, and a fluid circulation conduit for circulating liquid in the tub. The dishwasher appliance further includes a closed-loop adsorption assembly in fluid communication with the wash chamber, the closed-loop adsorption assembly including a desiccant assembly, the desiccant assembly comprising a desiccant module, a heating unit and a fan.

In some embodiments, the dishwasher appliance further includes a tub fan, the tub fan positioned within the interior and configured to actively flow air from the interior into the wash chamber.

In some embodiments, the dishwasher appliance further includes a controller, the controller in communication with the heating unit and the fan and configured for executing a wet cycle, wherein the heating unit and the fan are active during the wet cycle; executing a delay period, the delay period occurring for a predetermined time period between the wet cycle and a dry cycle, wherein the heating unit and the fan are active during the delay period; draining liquid from the wash chamber after the delay period; and executing a dry cycle, wherein the fan is active and the heating unit is inactive during the dry cycle.

In some embodiments, the dishwasher appliance further includes a controller, the controller in communication with the heating unit and the fan and configured for executing a wet cycle, wherein the heating unit and the fan are active during the wet cycle; executing a delay period, the delay period occurring for a predetermined time period between the wet cycle and a dry cycle, wherein the heating unit and the fan are inactive during the delay period; draining liquid from the wash chamber after the delay period; and executing a dry cycle, wherein the fan is active and the heating unit is inactive during the dry cycle.

In some embodiments, the controller is further in communication with the tub fan.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
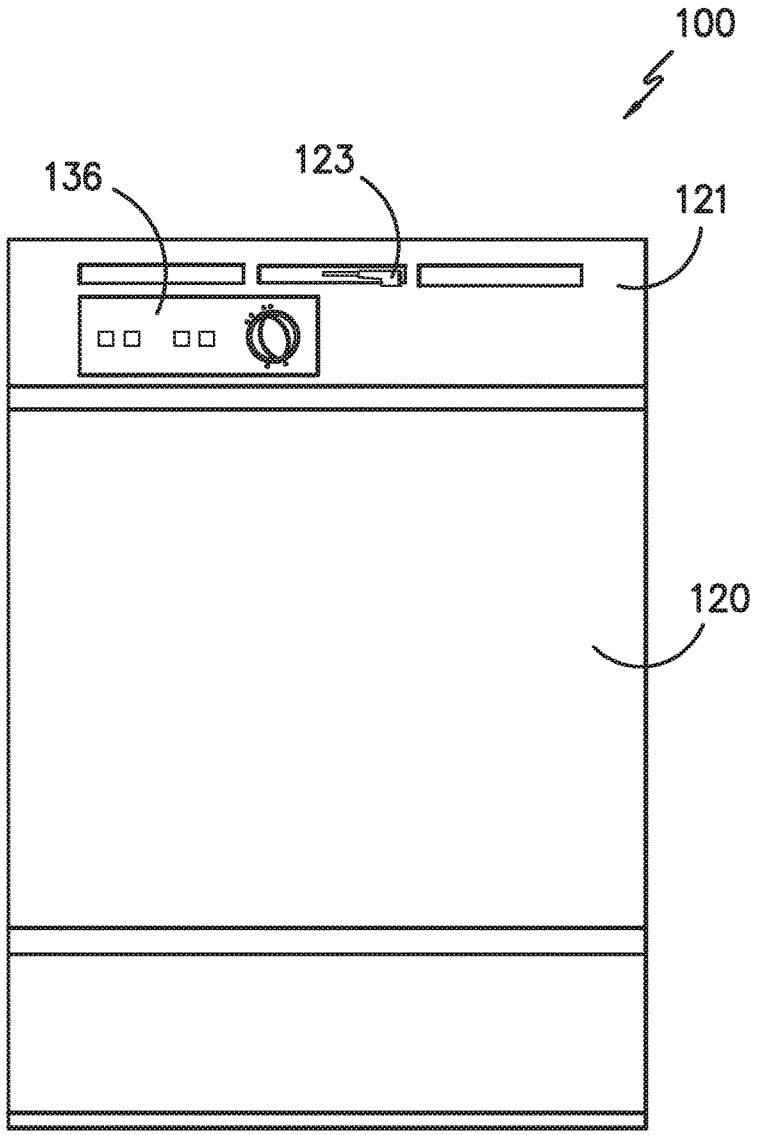
FIG. 1 provides a front, perspective view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
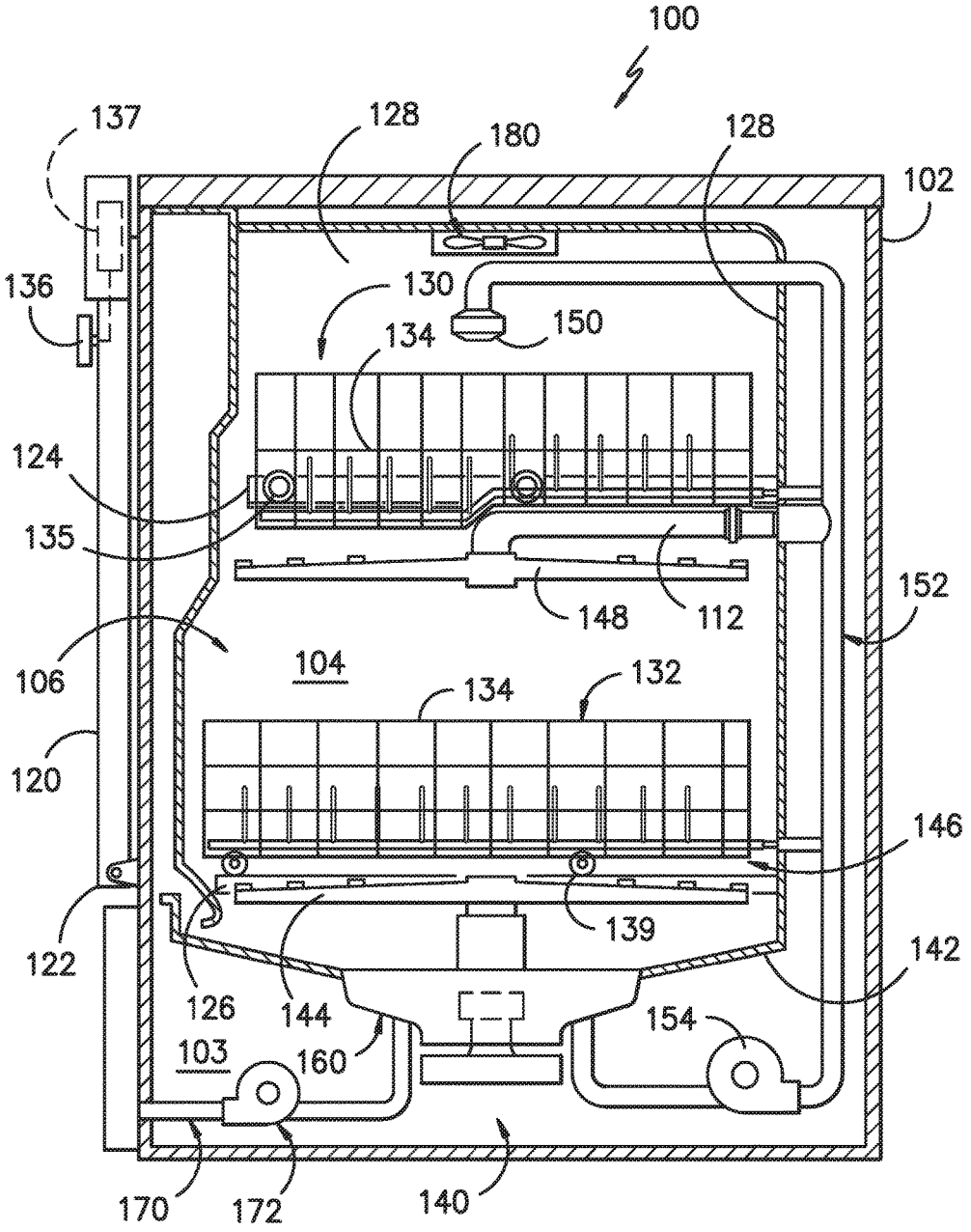
FIG. 2 provides a side, cross-sectional view of a dishwasher appliance in accordance with one embodiment of the present disclosure.
Figure 3:
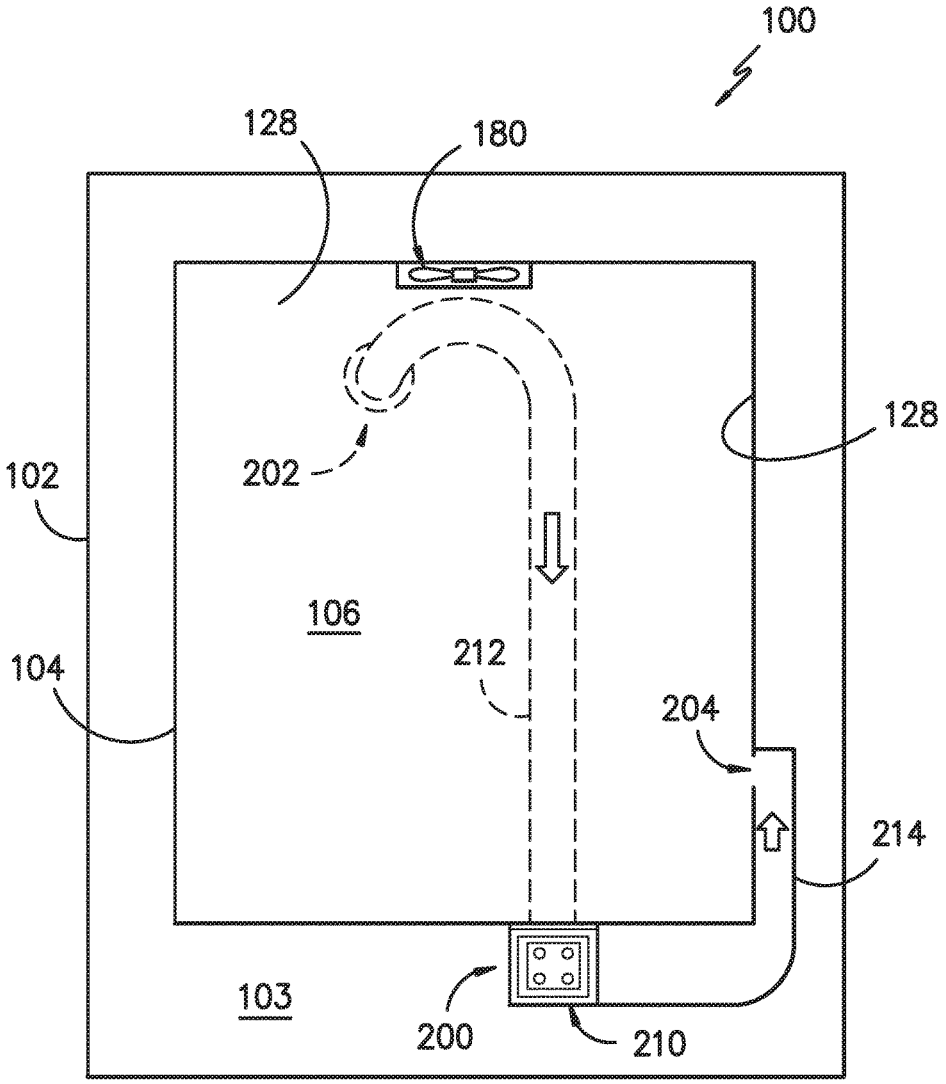
FIG. 3 provides a schematic view of various components of a dishwasher appliance, including a closed-loop adsorption assembly, in accordance with one embodiment of the present disclosure.

FIGS. 1 and 2 depict an exemplary domestic dishwasher appliance 100 that may be configured in accordance with aspects of the present disclosure. For the particular embodiment of FIG. 1, the dishwasher appliance 100 includes a cabinet 102 that defines an interior 103. A tub 104 is disposed in the interior 103. Tub 104 defines a wash chamber 106. Chamber 106 is configured for the receipt of articles for cleaning, such as dishes, cups, utensils, etc. The tub 104 includes a front opening (not shown) and a door 120 hinged at or near its bottom side wall 122 for movement between a normally closed vertical position (shown in FIGS. 1 and 2), wherein the wash chamber 106 is sealed shut for washing operation, and a horizontal open position for loading and unloading of articles from the dishwasher appliance 100. Latch 123 is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher appliance 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

The lower and mid-level spray-arm assemblies 144, 148 and the upper spray assembly 150 are fed by a fluid circulation conduit 152 for circulating water and dishwasher fluid (generally referred to as liquid) in the tub 104. A first pump 154, which may for example be located in a machinery compartment 140 located below the bottom sump portion 142 of the tub 104, may flow liquid from sump 160 to and through the fluid circulation conduit 152. Each spray-arm assembly 144, 148 includes an arrangement of discharge ports or orifices for directing washing liquid onto dishes or other articles located in rack assemblies 130 and 132. The arrangement of the discharge ports in spray-arm assemblies 144, 148 provides a rotational force by virtue of washing fluid flowing through the discharge ports. The resultant rotation of the lower spray-arm assembly 144 provides coverage of dishes and other dishwasher contents with a washing spray.

A drain conduit 170 may additionally be provided for draining water and dishwasher fluid (generally referred to as liquid) from the tub 104. A second pump 172, which may for example be located in the machinery compartment 140, may flow liquid from sump 160 to and through drain conduit 170. This liquid may be flowed from the appliance 100 generally, such as to the plumbing of a structure in which the appliance 100 is provided.

Dishwasher appliance 100 may further include a tub fan 180. Tub fan 180 may facilitate air flow within the wash chamber 106 at various times during operation of the dishwasher appliance 100. The tub fan 180 may be positioned within the interior 103, and may in some embodiments be positioned at least partially or entirely in the wash chamber 106. For example, tub fan 180 may be disposed in the wash chamber 106 proximate a wall of the tub 104, such as an upper wall (along a vertical direction) as illustrated. The tub fan 180 may, when activated, actively flow air within the wash chamber 106 and over articles disposed therein.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom side wall 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

Controller 137 may further be in communication with various component of the appliance 100, such as the first and second pumps 154, 172, tub fan 180 and a heating unit and a fan of a desiccant assembly as discussed herein. Accordingly, controller 137 may send signals to these various components to activate and deactivate the components as required during operation of the dishwasher appliance 100 in a wash cycle.

In general, dishwasher appliance 100 may utilize a variety of cycles to wash and, optionally, dry articles within chamber 106. For example, a wet cycle is utilized to wash articles. The wet cycle may include a main wash cycle and a rinse cycle, as well as an optional pre-wash cycle. During each such cycle, water or another suitable liquid may be utilized in chamber 106 to interact with and clean articles therein. Such liquid may, for example, be directed into chamber 106 from lower and mid-level spray-arm assemblies 144, 148 and the upper spray assembly 150, such as via fluid circulation conduit 152 and pump 154. The liquid may additionally mix with, for example, detergent or other various additives which are released into the chamber during various sub-cycles of the wet cycle.

For example, during a wet cycle, a pre-wash cycle may additionally be executed. In the pre-wash cycle, water is directed into chamber 106, with no detergent (other than detergent remnants in the chamber 106 from a previous wet cycle) being mixed with the water. After the pre-wash cycle, a wash cycle may be executed. In the wash cycle, water is directed into the chamber 106 and mixed with detergent. After the wash cycle, a rinse cycle may be executed. In the rinse cycle, water is directed into the chamber 106, with no additional detergent (other than detergent remaining in the chamber 106 due to the wash cycle) being mixed with the water. Notably, liquid within the wash chamber 106 may be drained between the pre-wash cycle and the wash cycle, and between the wash cycle and the rinse cycle. Drain conduit 170 and second pump 172 may be utilized for such drainage. Liquid within the wash chamber 106 may additionally be drained after the rinse cycle, such as via drain conduit 170 and second pump 172. Such drainage may, as discussed herein, occur after a delay period is executed as discussed herein.

A dry cycle may be utilized to dry articles after washing in the wet cycle. During a drying cycle, for example, moisture within chamber 106 may be adsorbed as discussed herein to facilitate drying of the articles within the chamber 106. In generally, no liquid is sprayed or otherwise produced or directed into the wash chamber 106 during the drying cycle.

It should be appreciated that the invention is not limited to any particular style, model, or other configuration of dishwasher, and that the embodiment depicted in FIGS. 1 and 2 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles. Other configurations may be used as well.

Referring now to FIGS. 3 through 7, dishwasher appliances 100 according to the present disclosure may further include various components which facilitate improved air recirculation and energy recovery during operation of the appliance 100. In particular, dishwasher appliances 100 may utilize desiccants to adsorb moisture, in particular during the drying cycle, and desorb such moisture during the wet cycle. Such adsorption and desorption may reduce or eliminate the need to vent air from the dishwasher appliance 100 during operation. Further, desorption may facilitate fluid heating within the dishwasher appliance 100, thus providing improved efficiency by causing the dishwasher appliance 100 to require less heating. Notably, in exemplary embodiments, no heating elements are required in the wash chamber 106, with the only heating elements required being components of the adsorption assembly which provides such advantages as discussed herein.

As illustrated, a dishwasher appliance 100 in accordance with the present disclosure may include a closed-loop adsorption assembly 200. The closed-loop adsorption assembly 200 is in fluid communication with the wash chamber 106, such that fluid is flowable to the adsorption assembly 200 from the wash chamber 106 and to the wash chamber 106 from the adsorption assembly 200. Adsorption assembly 200 thus may include an inlet 202 defined in the tub 104 and an outlet 204 defined in the tub 104. As discussed herein, adorption and desorption of moisture may advantageously occur within adsorption assembly 200.

In particular, adsorption assembly 200 may further include a desiccant assembly 210 in which adsorption and desorption of moisture may occur. Desiccant assembly 210 may be in fluid communication with the inlet 202 and the outlet 204. For example, in some embodiments, desiccant assembly 210 may be directly connected to the inlet 202 and/or outlet 204. In other embodiments, conduits may extend between the inlet 202 and/or outlet 204 and the desiccant assembly 210. As shown, assembly 200 may further include an inlet conduit 212 extending between the inlet 202 and the desiccant assembly 210 for flowing fluid from the wash chamber 106 to the desiccant assembly 210 (such as to an inner passage thereof as discussed herein). As further shown, assembly 200 may further include an outlet conduit 214 extending between the desiccant assembly 210 and the outlet 204 for flowing fluid from the desiccant assembly 210 (such as an outer passage thereof as discussed herein) to the wash chamber 106.

In exemplary embodiments as shown, the desiccant assembly 210, as well as inlet and outlet conduits 212, 214, may be disposed in the interior 103 (but exterior to the tub 104).

Desiccant assembly 210 generally includes various passages through which fluid may flow. As shown, desiccant assembly 200 may include an inner passage 222, an intermediate passage 224, and an outer passage 226. The inner passage 222 may receive fluid from the wash chamber 106. Accordingly, inner passage 222 may be directly connected to the inlet 202 or to the inlet conduit 212, such that fluid flows from the inlet 202 and/or inlet conduit 212 into the inner passage 222. Intermediate passage 224 may surround the inner passage 222, and outer passage 226 may surround the intermediate passage 226. Fluid received in the inner passage 224 may be flowable through the intermediate passage 224 to the outer passage 226. Further, wash chamber 106 may receive fluid from the outer passage 226. Accordingly, outer passage 226 may be directly connected to the outer 204 or to the outlet conduit 214, such that fluid flow from the outer passage 226 through the outlet conduit 214 and/or outlet 204.

In exemplary embodiments, desiccant assembly 210 may include various conduits which define the various passages thereof. For example, desiccant assembly 210 may further include an inner conduit 232 which defines the inner passage 222, an intermediate conduit 234 which surrounds the inner conduit 222 and defines the intermediate passage 224, and an outer conduit 236 which surrounds the intermediate conduit 234 and defines the outer passage 236. In exemplary embodiments as shown, the inner conduit 232 and the intermediate conduit 234 are perforated, and thus define perforations 233, 235 respectively therethrough, through which fluid can flow.

It should be noted that in some embodiments the inner conduit 232 can be an integral extension of the inlet conduit 212 and/or the outer conduit 236 can be an integral extension of the outlet conduit 214. In some alternative embodiments, the inner conduit 232 can be a separate component that is coupled to the inlet conduit 212 and/or the outer conduit 236 can be a separate component that is coupled to the outlet conduit 214.

As shown, as desiccant module 240 is disposed in the intermediate passage 224, such that the desiccant module 240 generally surrounds the inner passage 222. Thus, fluid flowing from the inner passage 222 through the intermediate passage 224 to the outer passage 226 flows through the desiccant module 240 while flowing through the intermediate passage 224. This facilitates adsorption and desorption of moisture by the desiccant module 240.

In exemplary embodiments, the desiccant module 240 may include a granular desiccant 242, as shown. In exemplary embodiments, the granular desiccant 242 may be zeolite. Alternatively, however, the desiccant may be activated charcoal, calcium sulfate, calcium chloride, or another suitable molecular sieve, or any other suitable material, etc. In alternative embodiments, the desiccant module 240 may include a plurality of desiccant-coated plates (not shown). In exemplary embodiments, the desiccant coating the plates may be zeolite. Alternatively, however, the desiccant may be activated charcoal, calcium sulfate, calcium chloride, or another suitable molecular sieve, or any other suitable material, etc. The plates themselves may be formed from any suitable material, such as a suitable metal, polymer, ceramic, etc.

Figure 4:
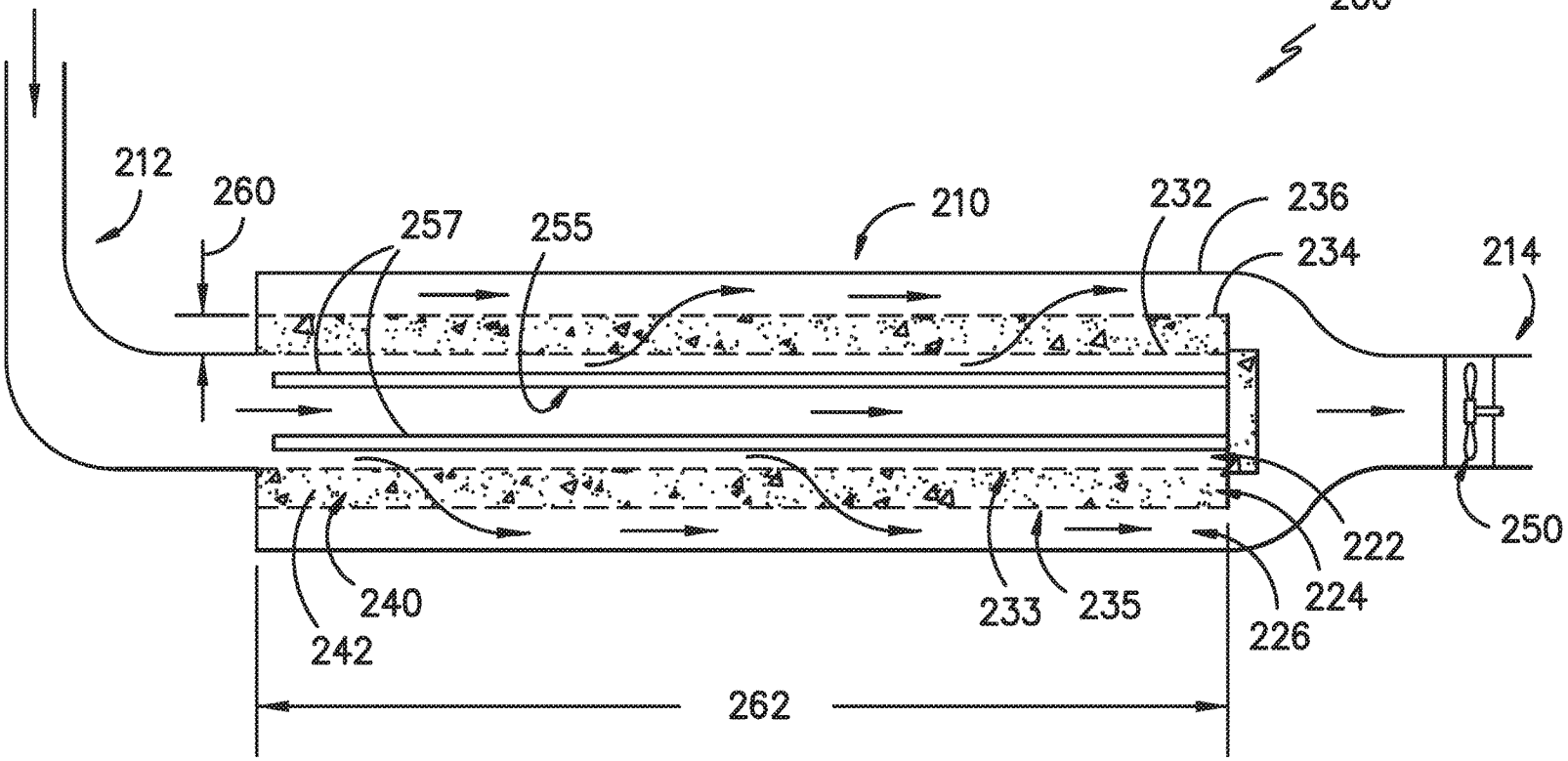
FIG. 4 provides a side cross-sectional view of components of a closed-loop adsorption assembly in accordance with one embodiment of the present disclosure.
Figure 5:
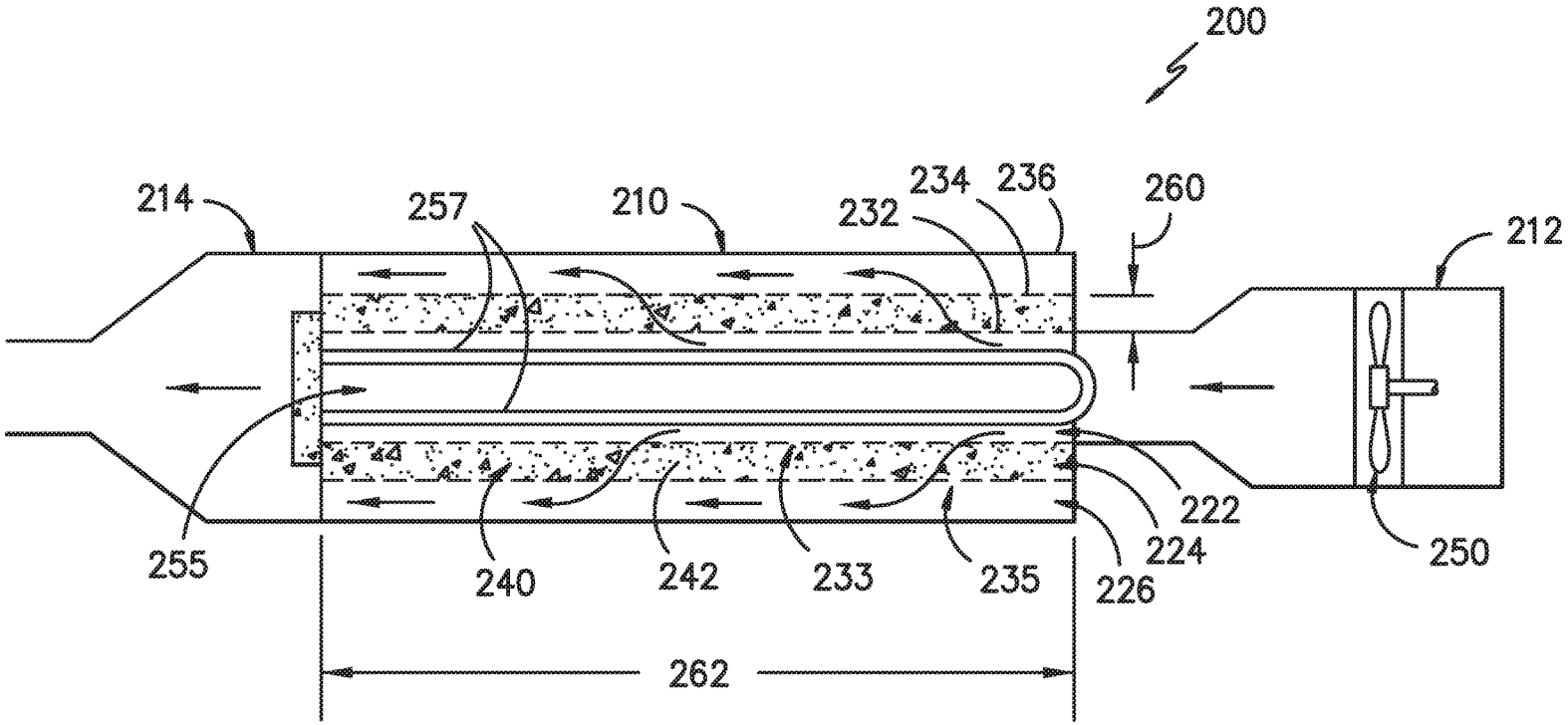
FIG. 5 provides a side cross-sectional view of components of a closed-loop adsorption assembly in accordance with another embodiment of the present disclosure.

Adsorption assembly 200 may further include various components to facilitate adsorption and desorption as required. For example, adsorption assembly 200 may include a fan 250. The fan 250 may encourage fluid flow through the desiccant assembly 210 and adsorption assembly 200 generally. In some embodiments as shown in FIG. 4, fan 250 is disposed downstream of the desiccant assembly 210 (relative to the flow direction of fluid through the adsorption assembly 200), such as within the outlet conduit 214. In other embodiments as shown in FIG. 5, fan 250 is disposed upstream of the desiccant assembly 210 (relative to the flow direction of fluid through the adsorption assembly 200), such as within the inlet conduit 212. In still other embodiments, fan 250 may be disposed within the desiccant assembly 210, such as in inner passage 222.

Figure 6:
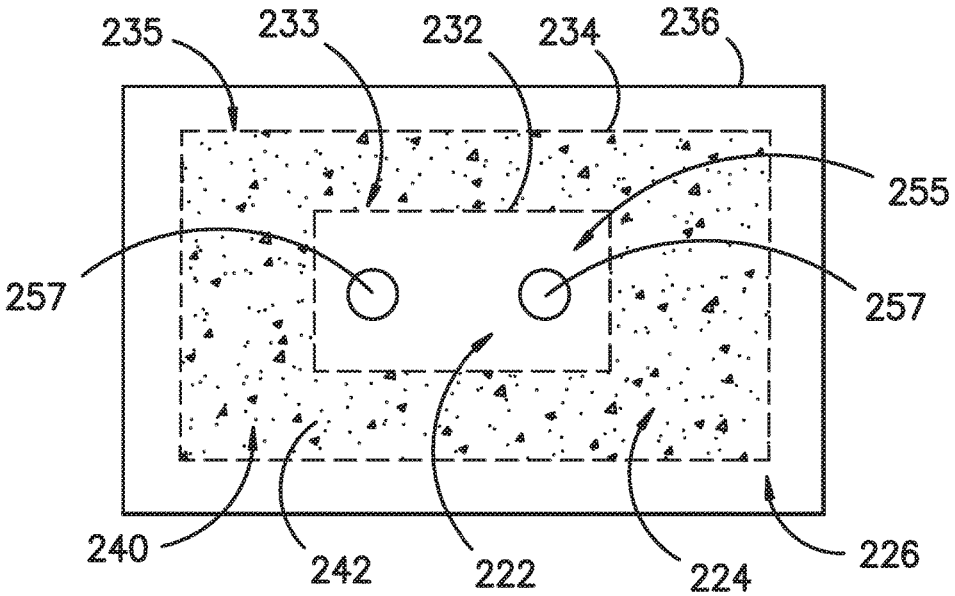
FIG. 6 provides a cross-sectional profile view of a desiccant assembly of a closed-loop adsorption assembly in accordance with one embodiment of the present disclosure.
Figure 7:
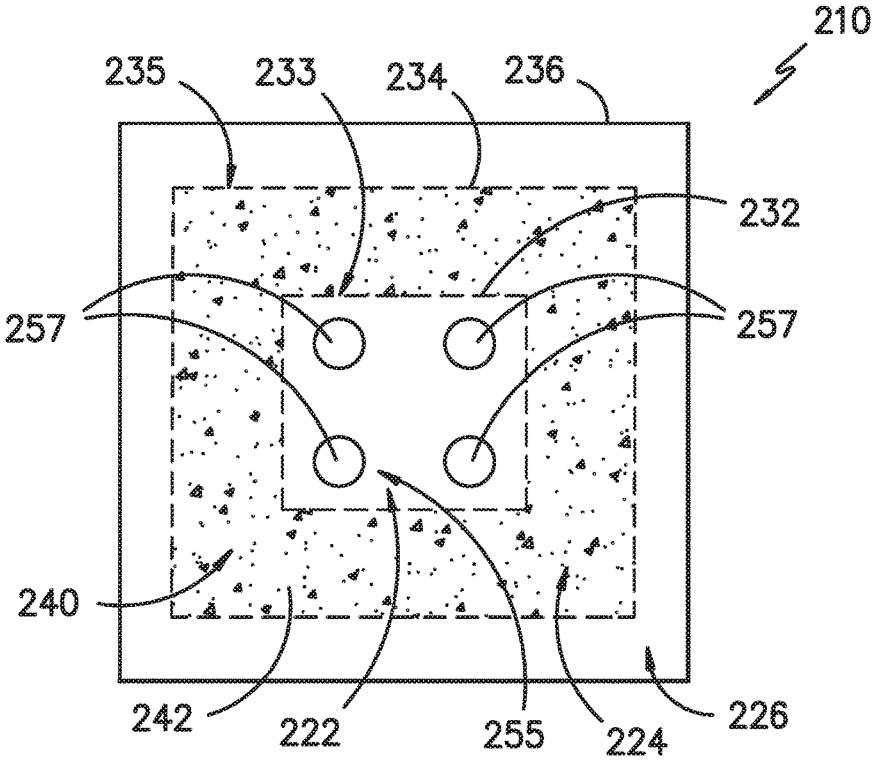
FIG. 7 provides a cross-sectional profile view of a desiccant assembly of a closed-loop adsorption assembly in accordance with another embodiment of the present disclosure.

Adsorption assembly 200 may further include a heating unit 255, which may be included in the desiccant assembly 210. The heating unit 255 may include one or more heating elements 257, such as two (as shown in FIG. 6), three, four (as shown in FIG. 7) or more. In some embodiments, two or four heating elements 257 may be desirable due to the rectangular cross-sectional profile of the various passages 222, 224, 226, as discussed herein. In exemplary embodiments, the heating unit 255, such as the heating elements 257 thereof, may be disposed within the inner passage 222. These embodiments are particularly advantageous because a substantial portion of the heat emitted by the heating unit 255 is trapped by the desiccant module 240. Accordingly, these embodiments are particularly energy efficient. In alternative embodiments, however, the heating unit 255, such as the heating elements 257 thereof, may for example be disposed within the outer passage 226.

Each heating element 257 may extend through the desiccant assembly 210 between the inlet of the desiccant assembly 210 (on the upstream side thereof) and the outlet of the desiccant assembly 210 (on the downstream side thereof). In some embodiments, the heating elements 257 may have constant wattages therethrough between the inlet side and the outlet side thereof. Alternatively, however, the heating elements 257 may have variable wattages therethrough between the inlet side and the outlet side thereof. For example, the wattage of a heating element 257 may be greater at the inlet side and may decrease from the inlet side to the outlet side, to reduce or prevent temperature gradients in the desiccant module 240 along the length thereof between the inlet side and the outlet side.

Referring now to FIGS. 6 and 7, the passages 222, 224, 226 of the desiccant assembly 210 may in exemplary embodiments each have a generally rectangular cross-sectional profile. In further exemplary embodiments, the rectangle may be a square. Square cross-sectional profiles are illustrated in FIG. 7, while other rectangular cross-sectional profiles are illustrated in FIG. 6. Such cross-sectional profiles may advantageously facilitate efficient fluid flow through the passages 222, 224, 226, in particular relative to oval or circular cross-sectional profiles. For example, oval or circular cross-sectional profiles may encourage generally helical flow patterns for fluid through the passages 222, 224, 226, while rectangular cross-sectional profiles encourage the patterns to be relatively less helical and more axial. Accordingly the fluid flow using such rectangular cross-sectional profiles can be relatively more efficient. It should be understood, however, that the present disclosure is not limited to rectangular cross-sectional profiles. Rather, any suitable profiles, including oval or circular cross-sectional profiles, are within the scope and spirit of the present disclosure.

Referring again to FIGS. 4 and 5, the intermediate passage 224 (which houses the desiccant assembly 240) has a thickness 260 as illustrated. In exemplary embodiments, the thickness 260 is relatively small, thus encouraging efficient fluid flow therethrough and reducing restrictions caused by the desiccant assembly 240. For example, in some embodiments, a maximum thickness 260 of the intermediate passage 224 is between approximately 15 millimeters and approximately 50 millimeters, such as between approximately 20 millimeters and approximately 40 millimeters.

Intermediate passage 224 may further have a length 262. The length 262 may in exemplary embodiments be sized relative to the thickness 260 to ensure adequate adsorption and desorption capabilities for the desiccant assembly 240 disposed in the intermediate passage 224. For example, in some embodiments, a maximum length 262 of the intermediate passage 224 is between approximately 200 millimeters and approximately 400 millimeters, such as between approximately 250 millimeters and approximately 350 millimeters.

It should be understood that the present disclosure is not limited to the above-disclosed embodiments of adsorption assembly 200 and desiccant assembly 210. Rather, any suitable adsorption assembly 200 which utilizes a desiccant assembly 210, and any suitable desiccant assembly 210 which utilizes a desiccant module 240, a heating unit 255 and/or a fan 250 is within the scope and spirit of the present disclosure.

Figure 8:
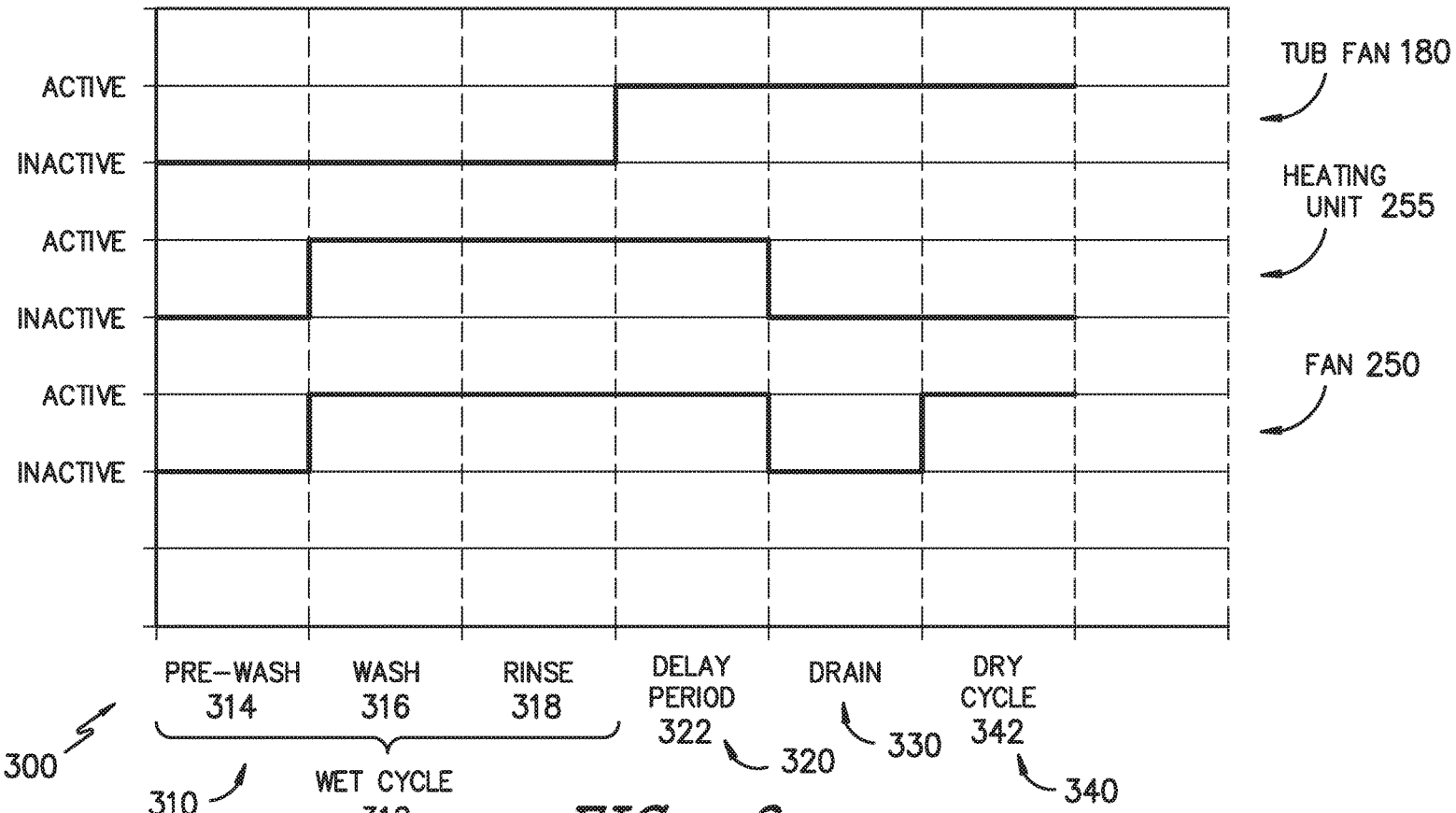
FIG. 8 is a chart illustrating operation of various components of a dishwasher appliance in accordance with one embodiment of the present disclosure.
Figure 9:
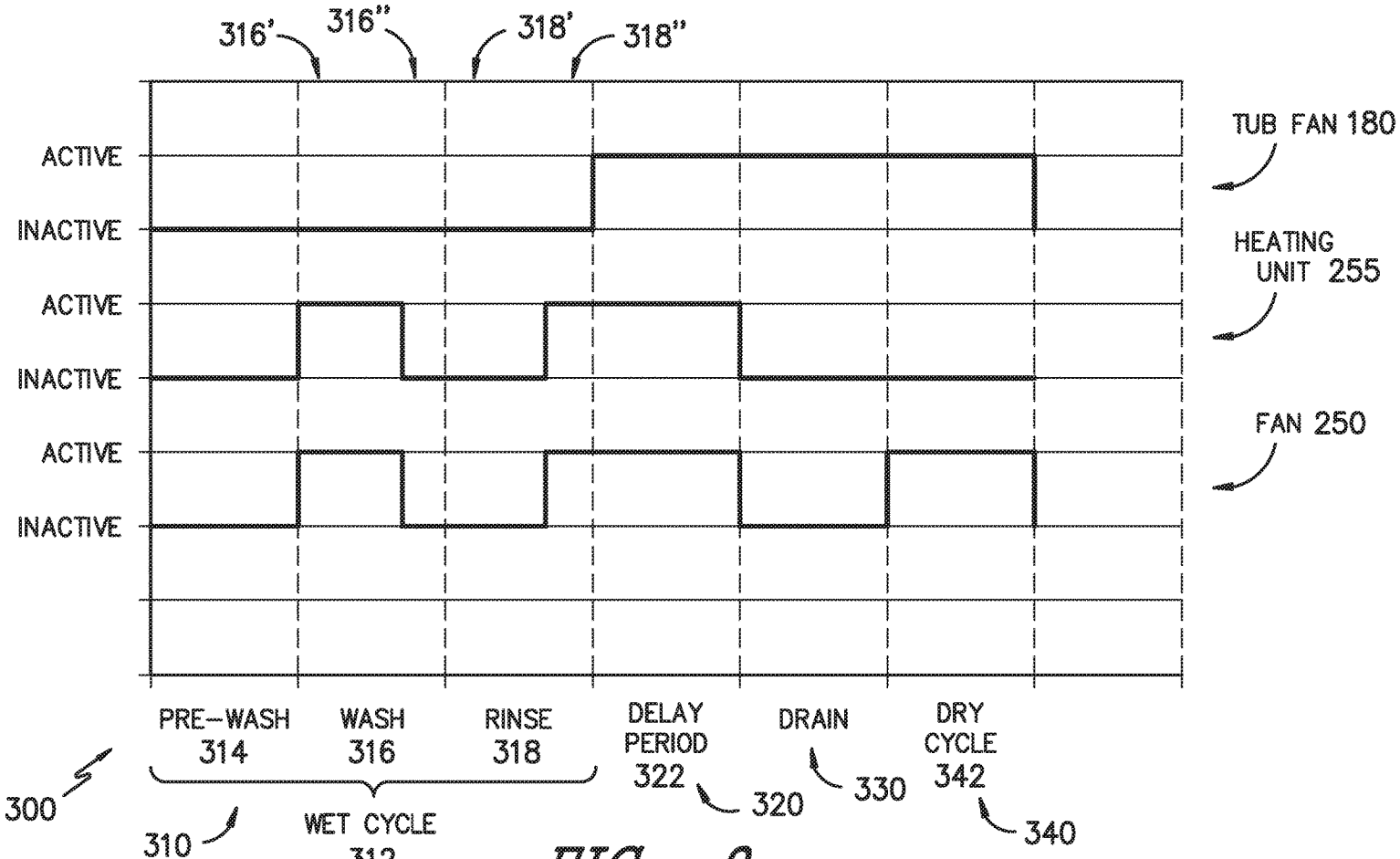
FIG. 9 is a chart illustrating operation of various components of a dishwasher appliance in accordance with another embodiment of the present disclosure.
Figure 10:
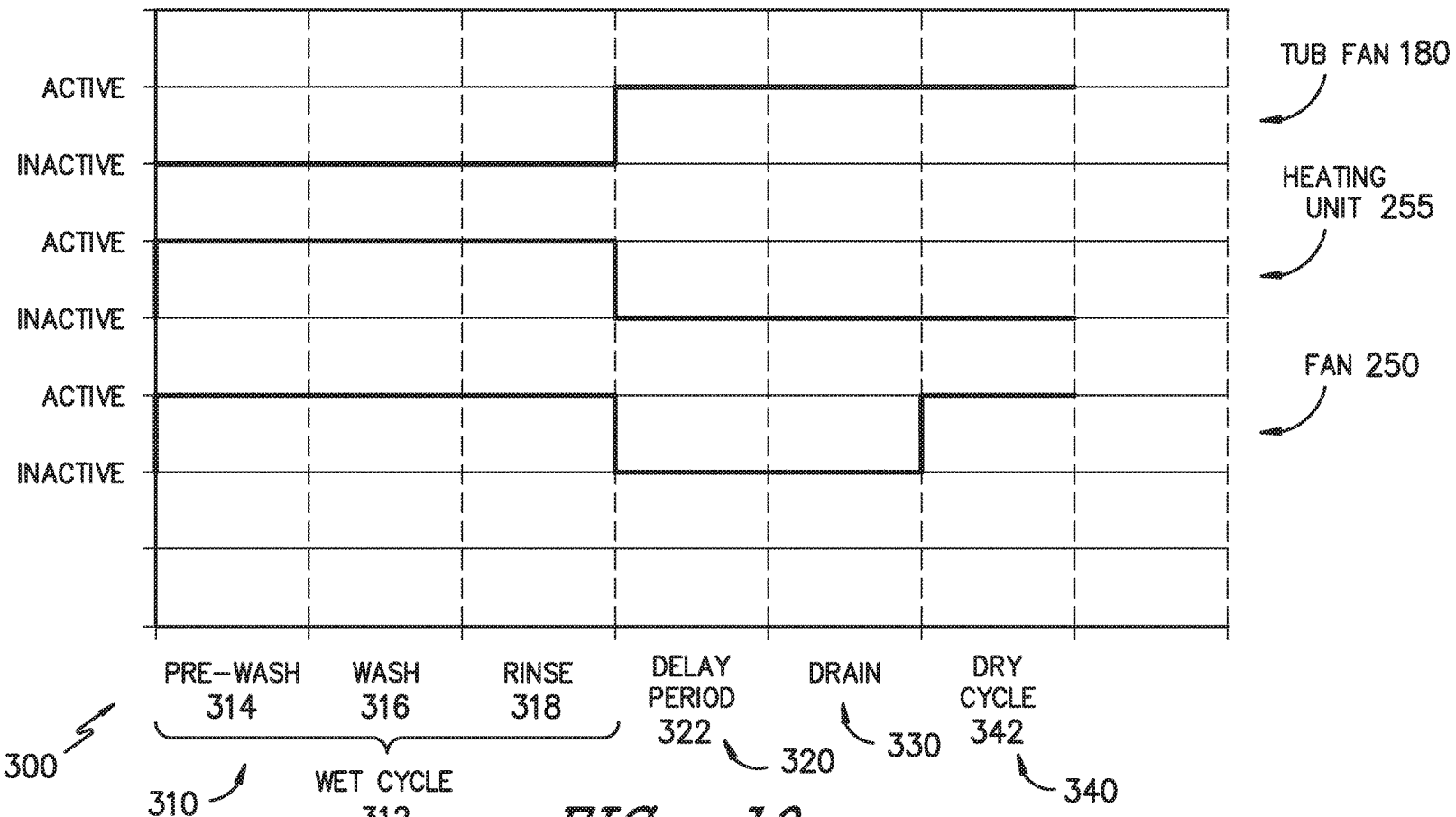
FIG. 10 is a chart illustrating operation of various components of a dishwasher appliance in accordance with another embodiment of the present disclosure.

Referring now to FIGS. 8 through 10, the present disclosure is further directed to methods for operating dishwasher appliances 100. In exemplary embodiments, the various steps of methods as discussed herein may be performed by controller 137. Methods in accordance with the present disclosure facilitate efficient use of the adsorption assembly 200 and desiccant assembly 210 to promote improved heating of water during the wet cycle and improved drying of articles during the dry cycle.

For example, a method 300 in accordance with the present disclosure may include the step 310 of executing a wet cycle 312. Wet cycle 312 may include, for example, one or more of a pre-wash cycle 314, a wash cycle 316 and a rinse cycle 318. During the wet cycle 312, the heating unit 255 and the fan 250 may be active. When active, the heating unit 255 may generate heat and the fan 250 may actively flow fluid therethrough. When inactive, the heating unit 255 may not generate heat and the fan 250 may not actively flow fluid therethrough. Further, the tub fan 180 may be inactive during the wet cycle 312. When active, the tub fan 180 may actively flow fluid therethrough. When inactive, the tub fan 180 may not actively flow fluid therethrough.

For example, in some embodiments, as illustrated in FIGS. 8 and 10, the heating unit 255 and the fan 250 may be continuously active during the entire wash cycle 316 and the entire rinse cycle 318. In other embodiments, as illustrated in FIG. 9, the heating unit 255 and the fan 250 may be active during only a portion of the wash cycle 316 and a portion of the rinse cycle 318. For example, the heating unit 255 and fan 250 may be active during a first portion 316' of the wash cycle 316, inactive during a second portion 316" of the wash cycle 316, inactive during a first portion 318' of the rinse cycle 318, and active during a second portion 318" of the rinse cycle 318. While in some embodiments as illustrated in FIGS. 8 and 9 the heating unit 255 and the fan 250 may be continuously inactive during the prewash cycle 314, in other embodiments as illustrated in FIG. 10 the heating unit 255 and the fan 250 may be continuously active during the prewash cycle 314. Accordingly, in some embodiments as illustrated in FIG. 10, the heating unit 255 and the fan 250 may be continuously active during the entire wet cycle 312, while in other embodiments as illustrated in FIGS. 8 and 9 the heating unit 255 and the fan 250 may be active during only a portion of the wet cycle 312.

Notably, in exemplary embodiments as illustrated in FIGS. 8 through 10, tub fan 180 may be continuously inactive during the entire wet cycle. Alternatively, tub fan 180 may be inactive during only a portion of the wet cycle.

Method 300 may further include, for example, the step 320 of executing a delay period 322. The delay period 322 may occur after the wet cycle 312 is executed in accordance with step 310 and before fluid is drained from wash chamber 106 in accordance with a step 330 as discussed herein, as well as before a dry cycle 342 is executed in accordance with step 340 as discussed herein. Further, in exemplary embodiments, no liquid may be drained from the wash chamber 106 after the wet cycle 312 is executed and before the delay period 322 is executed. Accordingly, liquid provided to wash chamber 106 during the final sub-cycle of step 310, typically the rinse cycle 318, may remain in the wash chamber 106 during the delay period 322. Further, no additional liquid may be provided to the wash chamber 106 during the step 320.

Delay period 322 may occur for a predetermined time period. In exemplary embodiments, the predetermined time period may be between 1 minute and 15 minutes, such as between 2 minutes and 10 minutes, such as between 3 minutes and 8 minutes, such as between 4 minutes and 7 minutes.

In some embodiments, as illustrated in FIGS. 8 and 9, the heating unit 255 and fan 250 may be active during the delay period 322. For example, in exemplary embodiments, the heating unit 255 and the fan 250 may be continuously active during the entire delay period 322. In alternative embodiments, as illustrated in FIG. 10, the heating unit 255 and fan 250 may be inactive during the delay period 322. For example, in exemplary embodiments, the heating unit 255 and the fan 250 may be continuously inactive during the entire delay period 322.

As illustrated in FIGS. 8, 9 and 10, in exemplary embodiments, the tub fan 180 may be active during the delay period 322. For example, the tub fan 180 may be continuously active during the entire delay period 322.

Method 300 may further include, for example, the step 330 of draining liquid from the wash chamber 106. Such step 330 may occur after the delay period 322 is executed in accordance with step 320. Further, as discussed above, liquid provided to wash chamber 106 during the final sub-cycle of step 310, typically the rinse cycle 318, may remain in the wash chamber 106 during the delay period 322 and until it is drained in accordance with step 330. In exemplary embodiments, as illustrated in FIGS. 8, 9 and 10, the heating unit 255 and the fan 250 may be inactive during the step 330 of draining liquid from the wash chamber 106. For example, the heating unit 255 and the fan 250 may be continuously inactive during the entire step 330 of draining liquid from the wash chamber 106. Further, as illustrated in FIGS. 8, 9 and 10, in exemplary embodiments, the tub fan 180 may be active during the step 330 of draining liquid from the wash chamber 106. For example, the tub fan 180 may be continuously active during the entire step 330 of draining liquid from the wash chamber 106.

Method 300 may further include, for example, the step 340 of executing a dry cycle 342. Dry cycle 342 may occur after execution of the delay period 322 in accordance with step 320 and after liquid has been drained from the wash chamber 106. In exemplary embodiments as illustrated in FIGS. 8, 9 and 10, the heating unit 255 may be inactive during the dry cycle 342. For example, the heating unit 255 may be continuously inactive during the entire dry cycle 342. Additionally, the fan 250 may be active during the dry cycle 342. For example, the fan 250 may be continuously active during the entire dry cycle 342. Further, the tub fan 180 may be active during the dry cycle 342. For example, the tub fan 180 may be continuously active during the entire dry cycle 342.

As discussed, in exemplary embodiments, controller 137 may be in operable communication with various components of the dishwasher appliance 100, such as the pumps 154, 172, the tub fan 180, the heating unit 255 and the fan 250. Controller 137 may activate and deactivate such components as required and in accordance with the various method steps as discussed herein. Such operation may facilitate efficient and advantageous adsorption and regeneration/desorption of the desiccant to provide improved dishwasher appliance 100 operation. For example, when the heating unit 255 is active, the relatively higher temperatures within the desiccant assembly 210 may facilitate regeneration and desorption of the desiccant. The released heated moisture/humidity may flow from desiccant assembly 210 through outlet 204 into the wash chamber 106, where it may mix with and heat fluid in the wash chamber 106.

Additionally, heat generated by the heating unit 255 may facilitate initial drying of articles during the delay period 322. Such heat may be generated before the delay period 322 (with the heating unit 255 inactive during the delay period 322) or during the delay period 322 (with the heating unit 255 active during the delay period 322), depending on the operations of the heating unit 255, fan 250 and/or tub fan 180 during other steps of a method 300 in accordance with the present disclosure.

Further, when the heating unit 255 is inactive, relatively moist/humid fluid from the wash chamber 106 may flow into the desiccant assembly 210 through inlet 202, and this moisture/humidity may be adsorbed by the desiccant, which may be at relatively lower temperatures due to inactivity of the heating unit 255.

Accordingly, dishwasher appliances 100 and methods 300 in accordance with the present disclosure may advantageously provide improved, more efficient washing and drying of articles.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a cabinet defining an interior;

a tub disposed within the interior and defining a wash chamber for the receipt of articles for cleaning;

a sump for collecting liquid from the chamber;

a drain conduit for draining liquid from the tub;

a fluid circulation conduit for circulating liquid in the tub;

a closed-loop adsorption assembly in fluid communication with the wash chamber, the closed-loop adsorption assembly comprising a desiccant assembly, the desiccant assembly comprising a desiccant module, a heating unit and a fan; and a controller, the controller in communication with the heating unit and the fan and configured for:

executing a wet cycle, wherein the heating unit and the fan are active during the wet cycle;

executing a delay period, the delay period occurring for a predetermined time period between the wet cycle and a dry cycle, wherein the heating unit and the fan are active during the delay period;

draining liquid from the wash chamber after the delay period; and executing a dry cycle, wherein the fan is active and the heating unit is inactive during the dry cycle.

2. The dishwasher appliance of claim 1, wherein the wet cycle comprises a wash cycle and a rinse cycle, and wherein the heating unit and the fan are continuously active during the entire wash cycle and the entire rinse cycle.

3. The dishwasher appliance of claim 1, wherein the heating unit and the fan are active during only a portion of the wet cycle.

4. The dishwasher appliance of claim 1, wherein the fan is continuously active and the heating unit is continuously inactive during the entire dry cycle.

5. The dishwasher appliance of claim 1, wherein the predetermined time period is between 1 minute and 15 minutes.

6. The dishwasher appliance of claim 1, wherein the heating unit and the fan are inactive during the step of draining liquid from the wash chamber.

7. The dishwasher appliance of claim 1, further comprising a tub fan, the tub fan positioned within the interior and configured to actively flow air within the wash chamber, the controller in communication with the tub fan, and wherein the tub fan is active during the delay period and active during the dry cycle.

* * * * *